United States Patent [19]

Crum

[11] Patent Number: 5,022,526

[45] Date of Patent: Jun. 11, 1991

[54] LABEL-CONTAINING PACKAGE ASSEMBLY

[75] Inventor: Lynn B. Crum, Naperville, Ill.

[73] Assignee: American Labelmark Company, Chicago, Ill.

[21] Appl. No.: 503,224

[22] Filed: Apr. 2, 1990

[51] Int. Cl.[5] ..... B65D 71/40

[52] U.S. Cl. ..... 206/459; 40/311; 40/638; 40/642; 206/460; 215/230

[58] Field of Search ..... 40/299, 306–313, 40/359, 638, 642; 206/39, 39.7, 232, 447, 449, 459, 460, 831; 215/230

[56] References Cited

U.S. PATENT DOCUMENTS

| | | | |
|---|---|---|---|
| 1,896,834 | 2/1933 | Brown | 40/306 |
| 1,924,909 | 8/1933 | Brown | 40/306 |
| 2,127,081 | 8/1938 | Brown | 40/306 |
| 3,155,234 | 11/1964 | Knoll et al. | 206/232 |
| 4,534,582 | 8/1985 | Howard | 40/306 |
| 4,621,442 | 11/1986 | Mack | 40/638 |
| 4,711,686 | 12/1987 | Instance | 40/306 |
| 4,726,972 | 2/1988 | Instance | 40/638 |
| 4,744,161 | 5/1988 | Instance | 40/306 |
| 4,868,027 | 9/1989 | Hunkeler et al. | 40/638 |

FOREIGN PATENT DOCUMENTS

| | | | |
|---|---|---|---|
| 0268044 | 5/1988 | European Pat. Off. | 40/638 |
| 2115775 | 9/1983 | United Kingdom | 40/312 |
| 2166109 | 4/1986 | United Kingdom | 40/638 |

*Primary Examiner*—Jimmy G. Foster
*Attorney, Agent, or Firm*—Mark I. Feldman

[57] ABSTRACT

A compact piggyback expandable package assembly safely dispenses labels for attachment to bottles, containers, and closure caps, as well as to other surfaces. The compact package assembly is particularly useful in the pharmaceutical industry, but can also be used for other applications. The package assembly comprises a special foldable package which encloses a set of labels. A resealable tab can be provided to facilitate opening and closing of the package. In the preferred form, the piggyback package assembly has a base or base label which is attached to the package. The underside of the base has adhesive portions so that the package assembly can be mounted upon the top surface of a closure cap of a bottle, a web, or some other surface.

9 Claims, 2 Drawing Sheets

PULL HERE TO OPEN
PRESS TO RESEAL

LABEL-CONTAINING PACKAGE ASSEMBLY

BACKGROUND OF THE INVENTION

This invention pertains to labels and, more particularly, to a package and method for dispensing labels.

In the pharmaceutical industry, it is important to deter and prevent tampering of pills and other medicine being transported, stored and dispensed, as well as to correctly identify the contents of the bottles and other containers in which the pills or other medicine are contained. To this end and in effort to control and secure the safe labeling of pharmaceutical bottles and other containers, pharmaceutical companies and suppliers have requested special packaging and labels to identify bulk bottles containing large amount of pills or other medicine, as well as to provide pharmacists with a tamper-resistant, piggyback packaging of additional labels for use by the pharmacist when the pharmacist repackages the pills or other medicine into smaller bottles and containers for sale to customers (patients).

Over the years many different types of labels have been developed for different industries: labels that have to be glued, taped, or stapled onto an object, preglued labels which adhere to an object after being moistened, self-sticking adhesive labels, etc.

Labels can be stored and dispensed from a roll, a box, and other types of packages. Often such packages are bulky, awkward, difficult to use, and not tamper resistant.

Typifying some of the many types of prior art labels and packaging are those shown in U.S. Pat. Nos. 4,583,763; 4,660,956; 4,711,686; and 4,747,618. These prior art labels and packaging have met with varying degrees of success.

It is, therefore, desirable to provide an improved label-containing package which overcomes most, if not all, of the preceding problems.

SUMMARY OF THE INVENTION

An improved composite, piggyback label-containing package assembly provides an effective and efficient expandable folder to safely and securely dispense labels for attachment to pharmaceutical bottles and closure caps, as well as to other types of containers and surfaces. Advantageously, the novel composite label-containing package assembly provides a unique labels on a label construction, security envelope, and an improved Fix-a-Form type product. Desirably, the novel label-containing package assembly is economical, compact, convenient, tamper-resistant, and easy to use.

To this end, the novel label-containing package assembly features: (1) a special package comprising a closure member to substantially enclose an array of labels, (2) a base or base label which is connected by an adhesive strip or other connector to the package, and (3) a closure assembly to close the package. The package is moveable from a closed folded position to an open expanded position. The base or base label can be releasably attached and secured to a backing web, closure cap, bottle, container, support member, or other surface by an adhesive material or other attachment device. Desirably, the special package includes flexible panels and flaps and a self-stick label-adhesive or other label-securing means to releasable connect the labels to the panels and flaps. In the preferred form, the flexible panels and flaps comprise folded accordion-type sheets which are compactly stacked upon each other when the package is in a closed position. The closure member can comprise a front outer end flap that provides the cover and top of the package, and a first inner flap that provides the bottom of the package when the package is in a closed position. The preferred closure member and assembly also includes a tab and an adhesive strip secured to the base to releasably seal the tab to the base.

A more detailed explanation of the invention is provided in the following description and claims taken in conjunction with the accompanying drawings.

DETAILED DESCRIPTION OF THE PREFERRED EMBODIMENTS

Figures 1, 2, 3, 4, 5, 6:
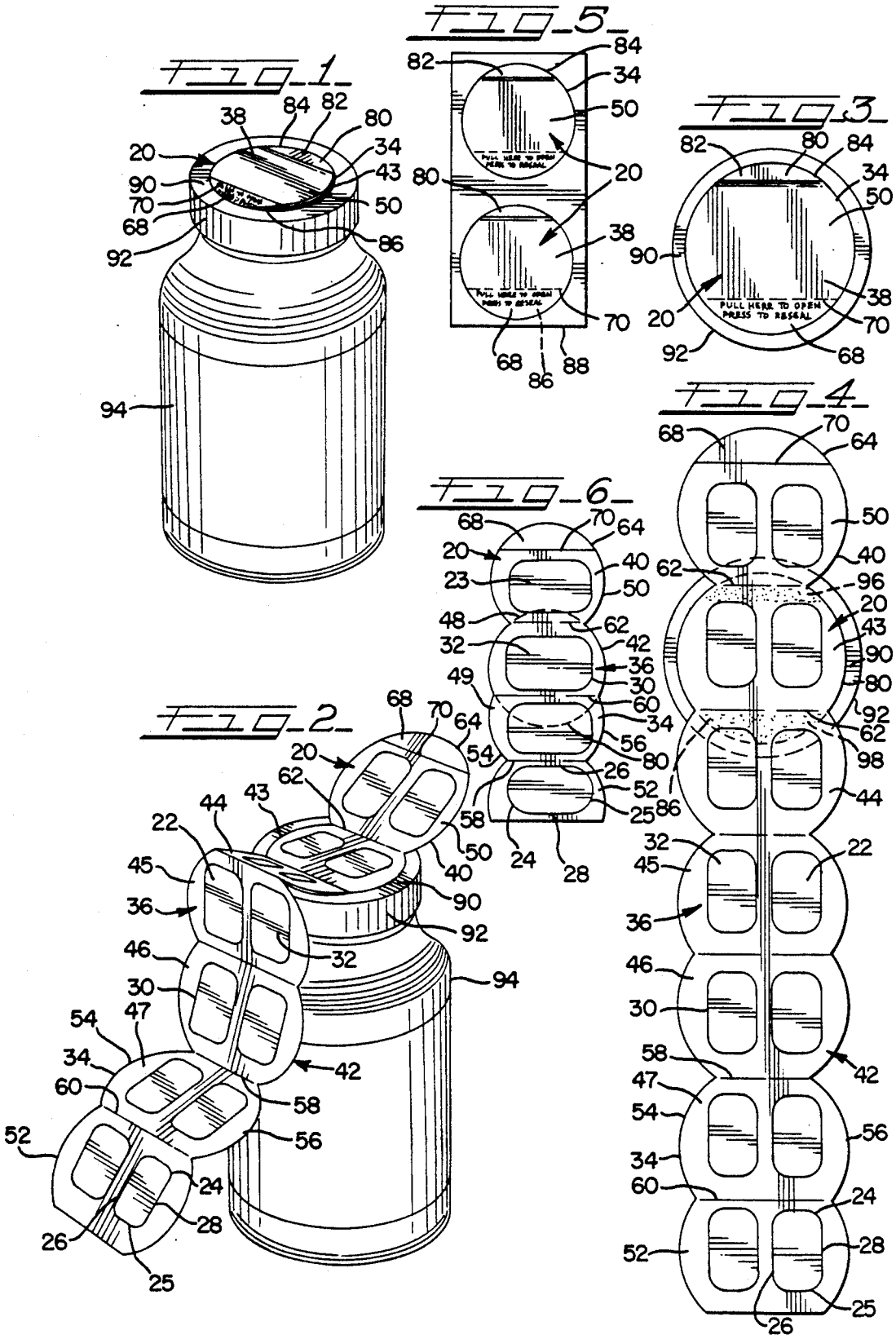
FIG. 1 is a perspective view of a closed label-containing package assembly attached to a closure cap of a pharmaceutical bottle in accordance with principles of the present invention.
FIG. 2 is a perspective view the label-containing package assembly of FIG. 1 in an open expanded position.
FIG. 3 is a top view of the closed label-containing package assembly of FIG. 1.
FIG. 4 is a top view of the open label-containing package assembly of FIG. 2.
FIG. 5 is a top view of other closed label-containing package assemblies releasably attached to a web in accordance with principles of the present invention.
FIG. 6 is a top view of one of the label-containing package assemblies of FIG. 5 in an open expanded position.
Figure 7:
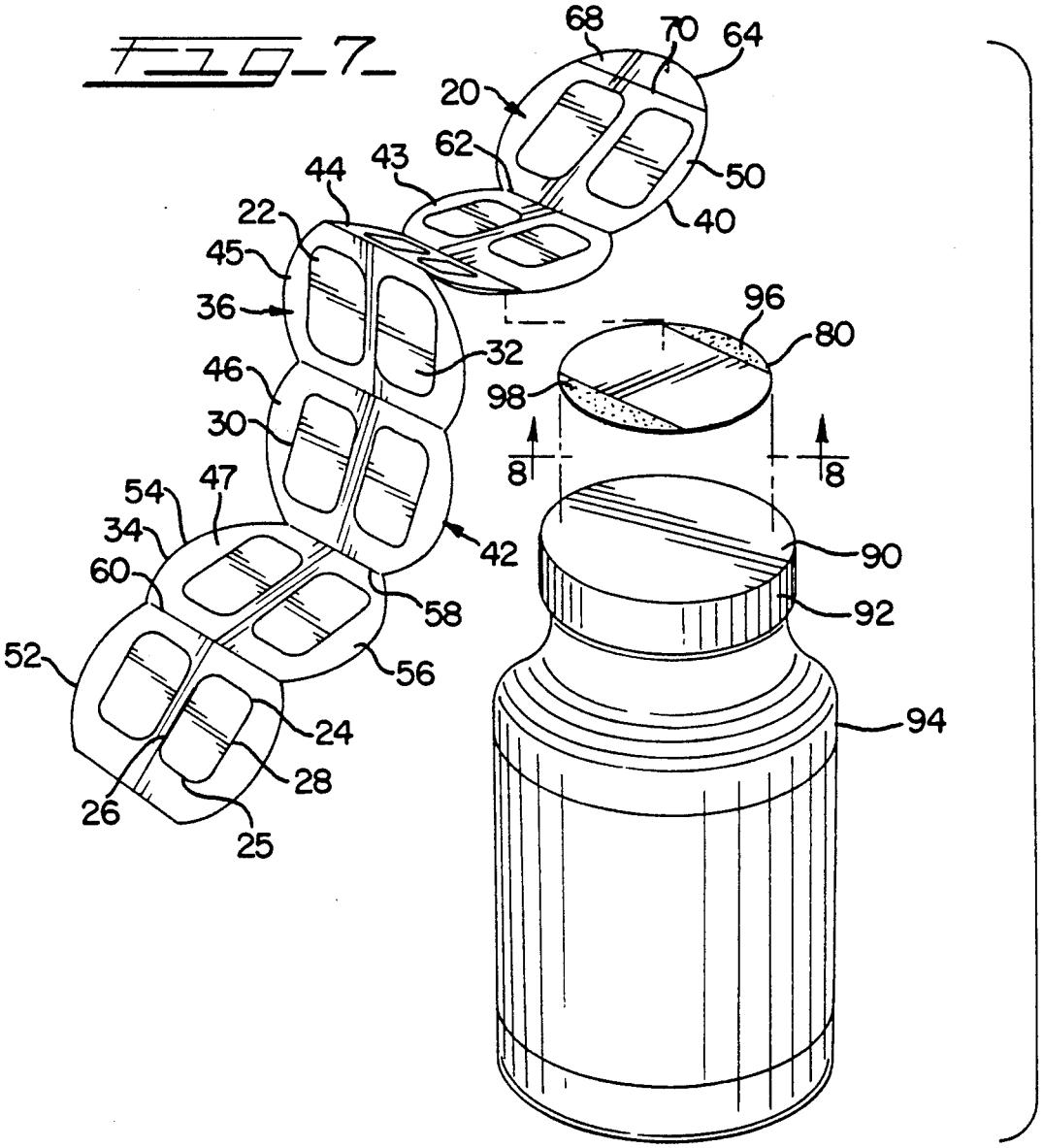
FIG. 7 is a top exploded view of the panel and base of the label-containing package assembly.
Figure 8:
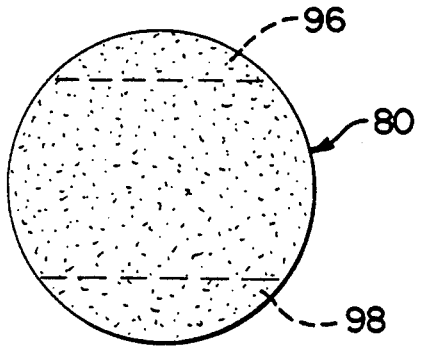
FIG. 8 is a bottom view of the base of the label-containing package assembly.

The composite label-containing label-dispensing package assembly 20 provides a labels on a label package and an improved Fix-a-Form type product. The composite label-containing package assembly 20 has a set, array, and series of removable pressure sensitive labels 22 or 23 (FIGS. 2, 4, and 6) providing additional, auxiliary, and supplemental labels for attachment to pharmaceutical bottles, containers, and other surfaces. The labels 22 and 23 can previously or subsequently contain printed or written identifying indicia and information. In the illustrative embodiments, the label are generally oblong with arcuate convex curved complementary ends 24 and 25 or corners and parallel straight edges 26 and 28 extending between and connecting the ends of the label. The labels 22 and 23 can have self-sticking releasable adhesive backing 30, a glossy front surface 32, and are made of paper. Other materials can be used.

In the embodiment comprising the bigger package assembly of FIGS. 2 and 4, there are 14 labels in each package with two parallel oblong labels 22 per panel member positioned transverse to the fold lines. In the smaller package assembly of the embodiment of FIG. 6, there are four parallel label 23 in each panel member with one oblong label per panel member positioned substantially parallel to the fold lines as well as substantially parallel to the bottom and top edges (ends) of the package. While the illustrated packages are preferred for convenience, simplicity of use, ease of manufacture, and efficiency, packages with a different amount of labels or with labels of different shapes, or packages with different configurations, can be used if desired.

In order to protect and control the dispensing of labels 22 and 23, the composite label-containing package assembly 20 has a compact foldable piggyback safety package 34 which provides an expandable security folder and envelope. The package 34 is moveable from a folded contracted closed position as shown in FIGS. 1, 3, and 5 to an expanded open position as shown in FIGS. 2, 4, and 6 for access and removal of the labels 22 or 23.

The package 34 comprises a foldable accordion-like leaflet and pamphlet 36 with an exterior glossy surface 38 (FIGS. 1, 3, and 5) and an interior inner surface 40 (FIGS. 2, 4, and 6) upon which the labels 22 or 23 are releasably mounted. The inner and/or outer surfaces can be coated with a glossy material, such as silicon. Other glossy materials can be used.

The leaflet 36 comprises a stackable, complementary hingeably connected array, set, and series of flexible panel members 42 with symmetrical intermediate inner panels 43–47 (FIGS. 2 and 4) or 48 and 49 (FIG. 6) and complementary outer end flaps 50 and 52 including a top or front end flap 50. The panel members preferably comprise flexible folder paper sheets. The inner panels are of a similar size and shape and are complementary in shape to each other and to the bottom end flap 52 (FIGS. 2, 4, and 6). In the illustrative embodiments, the panels have symmetrical, opposite convex, curved, arcuate side edges 54 and 56 and parallel straight hinged end edges 58 and 60 which extend between and connect the arcuate side edges. The straight end edges 58 and 60 provide hinge members and fold lines or score lines which connect the panel members. The arcuate side edges have an arc less than 180 degrees, preferably from 60 to 100 degrees, and most preferably about 90 degrees.

The first inner flap 43 (FIGS. 2 and 4) or 48 (FIG. 6) which is hinged to and positioned adjacent the top end flap, provides the bottom of the package and leaflet when the package or leaflet is in the closed position.

An enlarged circular planar or flat base 80 (FIGS. 1, 3, and 5) provides a flexible base label with a glossy inwardly facing front top surface 82 coated with silicone and an underside or back surface 84. The underside 84 has at least one bottom adhesive portion 86 (FIGS. 1 and 5), such as a single adhesive segment or a complementary pair of arcuate partial crescent shaped bottom adhesive strips and segments, to releasably connect the base 80 to an elongated paper web 88 (FIG. 5) comprising a paper strip providing a backing sheet, or to the top exterior surface 90 (FIG. 1) of a closure cap 92 of a pharmaceutical bottle 94, or on a container, support member, or other support surface. A first partial crescent-shaped adhesive strip and segment 96 (FIG. 4) is attached to an upper portion of the front top surface 82 of the base 80 to securely connect the base to the underside of the bottom panel 43 (FIG. 4) or 48 (FIG. 6) providing the back of the package. A second lower partial crescent-shaped adhesive strip and segment 98 (FIG. 4) is attached to the lower side portion of the front top surface 82 of the base 80 to releasably connect and seal the tab 68 to the base 80 when the package and leaflet is in the closed position as shown in FIGS. 1, 3, and 5.

Advantageously, the above arrangement and package provide a mechanism for a plurality of labels to be hidden within a structure that can be opened to remove one or more of the labels and subsequently resealed to protect the remaining labels. This is particularly advantageous for use by pharmacists, for example, who may take pills from a manufacturer's bottle, place some of those pills in a smaller container for an individual prescription. Desirably, a preprinted label from the manufacturer can be removed from the labels on a label package and placed on the individual prescription container.

The labels on a label package assembly comprises two main components. The first component is a base label which is releasably secured to a backing web that is on a roll during the manufacturing process. The top face of the base label has two strips of adhesive coating, a left (upper) adhesive strip and a right (lower) adhesive strip. The second main component comprises an elongated leaflet or pamphlet with an inner or top surface and an outer or bottom surface which is permanently secured to the top surface of the base. The labels are releasably secured to the inner or top surface of the leaflet. The labels can be die cut from a sheet with the excess material removed.

The leaflet can be folded over upon itself, with a plurality of folds determined by the length of the leaflet and the number of labels thereon. One end of the leaflet overlies and can be releasably secured to the adhesive strip 98 on the base label. The adhesive preferably comprises a permanent adhesive and can be applied with glue nozzles. Most preferably, the backing is releasably adhered to the silicone liner. The package and labels can be white or any other desired color. The cover (top flap) and labels on the leaflet can have printed indicia and information thereon. The tab can also have indicia, information, or instructions for use printed thereon.

In use, when a pharmacist or other user desires to obtain access to one of the labels, the leaflet is released from the corresponding strip of adhesive on the base label, the leaflet is open, and one or more of the labels is removed. A pharmacist or other user can then refold the leaflet and resecure the leaflet to the corresponding strip of adhesive on the base label. The preceding procedures can be repeated to remove additional labels.

The labels on a label package assembly can comprise a Fix-a-Form style, folded leaflet format with die cut labels. Four different size containers with two different quantities of tablets (100 and 500) use glue applied prime labels. Furthermore, the folded package inserts are designed and constructed to remain on the tops of each cap.

Individually removable pressure sensitive labels had not previously been used in the pharmaceutical industry. In this application, the printed die cut labels were sheeted, folded and glued to round pressure sensitive labels which then could be applied automatically to the tops of the previously applied folded leaflets. This provides a type of piggyback arrangement on the cap.

In use, the pharmacist can open the leaflet and remove one of the small oval labels and apply it to the prescription he is filling. The pharmacist can then easily reseal the leaflet which remains on top of the cap ready for the next use. The smaller illustrated package contains four oval labels, while the larger illustrated package contains 14 labels. Other size packages with different amounts of labels can be used, if desired.

Preferably, the outside or back of the leaflet liner can be printed with directions for the pharmacist. The packages also accommodates adhesion between the inside label and the silicone inside surface of the liner to create the resealable feature. The product protection remains intact since nothing has to be modified to receive the Fix-a-form type leaflet. Sizes of shipping containers can be uniform.

The labels on a label package is easy to use and contains all the information the patient needs. Desirably, the environment is not adversely affected by the paper Fix-a-Form style package.

The labels on a label package assembly accommodate business plans of some pharmaceutical companies to smooth the transition into a smaller tablet for some of their major products. They wanted their customer to be aware of the change, but realized that the ultimate consumer (the patient) was one step beyond the pharmacist. This illustrated labels on a label package assembly was an economical and easy to use way to bridge the gap between the manufacturers and patients (customers).

The novel labels on a label package assembly, comprising the label-containing labels-dispensing package assembly of this invention, has been favorably and enthusiastically received and has been in considerable demand by pharmaceutical companies, suppliers, and their customers, as well as met with substantial commercial success. To date over 1.5 million labels on a label package assemblies have been sold.

Among the many advantages of the novel labels on a label package assemblies, comprising the label-containing package assemblies of this invention, are:

1. Outstanding packages for dispensing labels for pharmaceutical products.
2. Superior piggyback packages for attachment to closure caps, bottles, and other surfaces.
3. Excellent appeal to customers.
4. Permits labels to be dispensed at different times.
5. Convenient.
6. Easy to use.
7. Simple to install.
8. Compact.
9. Economical.
10. Safe.
11. Efficient.
12. Effective.

While the label-containing package assemblies are particularly useful in the pharmaceutical industry, they can also be used with other types of containers as well as for other applications, such as games stickers for children.

Although embodiments of the invention has been shown and described, it is to be understood that various modifications and substitutions, as well as rearrangements of parts, can be made by those skilled in the art without departing from the novel spirit and scope of this invention.

What is claimed is:

1. A composite label-containing package assembly, comprising:

an array of labels for attachment to pharmaceutical bottles ad other surfaces;

a package comprising a closure member for substantially enclosing said labels, said package being movable from a folded closed position to an expanded open position for access and removal of said labels, said package comprising a foldable accordion-like leaflet upon which said pressure sensitive labels are releasably mounted;

said foldable leaflet comprising a stackable, complementary, hingeably connected array of panel members with intermediate inner panels and outer flaps including a top flap providing a protective cover and top for the package when said package is in said closed position, said cover having a main body portion and an outwardly extending portion comprising a manually graspable tab for facilitating opening and closing of said cover, said panels having a substantially similar complementary size and shape;

said panels including a first panel hingeably connected to said cover for providing a bottom with an underside of said package when said package is in said closed position;

a substantially planar base having a top surface and a bottom surface with adhesive thereon for releasably connecting said base to a closure cap, bottle, or other support surface;

first adhesive for connecting said top surface of said base to the underside of said first panel providing said back of said packaging; and second adhesive means for releasably connecting and sealing said tab to said base when said package is in said closed position.

2. A composite label-containing package assembly in accordance with claim 1 wherein said base comprises an enlarged label.

3. A composite label-containing package assembly in accordance with claim 1 including a web comprising said support surface releasably connected to said base.

4. A composite label-containing package assembly, comprising:

an array of labels;

a package comprising a closure member for substantially enclosing said labels;

a base;

connecting means for closing said package to said base;

closure means for closing said package;

said package including a flexible panel and label-securing means for releasably connecting said labels to said panel; and said flexible panel means being connected to said closure member and comprising folded sheets.

5. A composite label-containing package assembly, comprising:

a set of pressure sensitive labels for attachment to pharmaceutical bottles and other surfaces;

a foldable package for substantially enclosing said labels, said package being movable from a folded closed position to an expanded open position for access and removal of said labels, said package comprising a foldable accordion-like leaflet upon which said pressure sensitive labels are releasably mounted;

said foldable leaflet comprising a stackable, complementary, hingeably connected array of panel members with intermediate inner panels and outer flaps including a top flap providing a protective cover and top for the package when said package is in said closed position, said cover having a main body portion and an outwardly extending portion comprising a manually graspable tab for facilitating opening and closing of said cover, said panels having a substantially similar complementary size and shape;

said panels including a first panel hingeably connected to said cover for providing a bottom of said package when said package is in said closed position, said first panel comprising said bottom having an underside, and said cover and bottom of said package cooperating with each other to provide a closure member;

a substantially planar base having a top surface and a bottom surface;

a first adhesive strip attached to said top surface of said base for connecting said base to the underside of said first panel providing said back of said package;

a second adhesive strip attached to said top surface of said base and spaced from first adhesive strip for releasably connecting and sealing said tab to said base when said package is in said closed position; and said bottom surface of said base having an adhesive portion for releasably connecting said base to a support surface selected from the group consisting of an elongated web, a closure cap of a pharmaceutical bottle, a container, and a support member.

6. A composite label-containing package assembly in accordance with claim 5 including an elongated web releasably connected to said bottom surface of said base.

7. A composite label-containing package assembly in accordance with claim 5 wherein said base comprises an enlarged flexible label.

8. A composite label-containing package assembly in accordance with claim 5 wherein said cover has an arcuate convex edge extending from about 225 degrees to about 315 degrees.

9. A composite label-containing package assembly in accordance with claim 8 wherein said panels have substantially symmetrical, convex side edges and substantially parallel straight hinged end edges extending between and connecting said side edges.

* * * * *